US006899052B2

(12) United States Patent
Nakajima et al.

(10) Patent No.: US 6,899,052 B2
(45) Date of Patent: May 31, 2005

(54) BATTERY MOUNTING STRUCTURE FOR A SMALL WATERCRAFT, AND METHOD OF USING SAME

(75) Inventors: Jun Nakajima, Saitama (JP); Takayoshi Miura, Saitama (JP); Yusuke Funayose, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/668,115

(22) Filed: Sep. 19, 2003

(65) Prior Publication Data

US 2004/0099199 A1 May 27, 2004

(30) Foreign Application Priority Data

Sep. 27, 2002 (JP) ..... 2002-284219

(51) Int. Cl.[7] ..... B63B 17/00
(52) U.S. Cl. ..... 114/343; 114/55.5
(58) Field of Search ..... 114/343, 363, 114/55.5, 55.57, 55.53, 55.56

(56) References Cited

U.S. PATENT DOCUMENTS 4,664,054 A * 5/1987 Nishida ..... 114/55.57
6,290,013 B1 * 9/2001 Bienenstein, Jr. ..... 180/68.5
6,439,329 B1 * 8/2002 Vaishnav et al. ..... 180/68.5
6,521,371 B1 * 2/2003 Lavanture ..... 429/100

* cited by examiner

*Primary Examiner*—Sherman Basinger
(74) *Attorney, Agent, or Firm*—Carrier, Blackman & Associates, P.C.; William D. Blackman; Joseph P. Carrier

(57) ABSTRACT

A battery mounting structure for a small watercraft is constructed and arranged to improve turning performance of the craft and to provide waterproofing protection. A vessel body 11 includes a hull 14, constituting a lower portion of the vessel body, and a deck 15 for covering on top of the hull. An engine 20 is disposed in the vessel body 11, with a drive shaft 35 extending rearward from the engine 20 for driving a propeller 30, and a drive shaft supporting box 18 for supporting the drive shaft at the midsection thereof. The inventive mounting structure is substantially centrally located, so that the battery 53 can be disposed on the drive shaft supporting box 18.

15 Claims, 6 Drawing Sheets

BATTERY MOUNTING STRUCTURE FOR A SMALL WATERCRAFT, AND METHOD OF USING SAME

CROSS-REFERENCE TO RELATED APPLICATIONS

The present application claims priority under 35 U.S.C. 119, based on Japanese patent application No. 2002-284219, filed Sep. 27, 2002.

BACKGROUND OF THE INVENTION

1. Field of the Invention

The present invention relates to a battery mounting structure for a small watercraft. More particularly, the present invention relates to a battery mounting structure for a small watercraft which provides for waterproofing protection and improves the turning characteristics of the small watercraft.

2. Description of the Background Art

A personal watercraft is known as a small size craft that is constructed and arranged to glide on the surface of a sea or lake. Many jet skis and other different types of personal watercraft are known and are commercially available.

In the background art, one example of a known type of battery mounting structure for a small watercraft is described in JP-A-10-194195. FIGS. 6(*a*) and 6(*b*) of the present application are reproduced from the disclosure of JP-A-10-194195, and are included herein for discussion of the previously known battery mounting structures.

In the above reference, as shown in FIGS. 6(*a*) and 6(*b*), a vessel body 1 includes a hull 1*a*, which constitutes a lower portion thereof, and a deck 1*b* for covering on top of the hull. The watercraft of FIGS. 6(*a*) and 6(*b*) is includes an engine inside of the vessel body, and is constructed in such a manner that a jet propeller 5 is driven by a drive shaft 3 extending rearward from an engine 2 disposed in the vessel body 1. Exhaust from the engine is expelled via an exhaust pipe 7.

The drive shaft 3 is supported by a drive shaft supporting box 6 at the midsection thereof, and batteries 4*a*, 4*b* are disposed separately on the right side and the left side of the vessel body 1 as shown in FIG. 6(*b*).

Small watercrafts of the type described in the above-cited reference are commonly used for sport racing as well as recreational purposes. In the case of sport racing, turning performance of the watercraft is a critical attribute and is a highly desirable. The ability to turn the watercraft within a tight and small turning radius is desirable for optimal performance. During operation of the small watercraft, the vessel can overturn in the water, resulting in at least a small amount of water entering the vessel.

In the battery structure in the background art as described above, the heavy batteries 4*a*, 4*b* are spaced a significant distance apart, as shown, and are disposed separately on the left and the right sides of the vessel body 1. With the weight distribution provided by the battery placement shown in FIG. 6(*a*), it is difficult to strike a weight balance and to centralize a mass (to place heavy parts at the center of the vessel as much as possible), and thus it is difficult to improve turning performance.

In addition, there is such problem that when restoring the vessel body 1 to a normal posture after having rolled over in the water, one of the batteries 4*a*, 4*b* disposed separately on the left and the right sides of the vessel body 1 comes in contact with water remaining in the vessel. Therefore, it is necessary to waterproof the batteries 4*a*, 4*b* very well, to prevent electrical problems and to insure that the operator is not stranded in open water in a "no start" condition.

Although the known devices have some utility for their intended purposes, a need still exists in the art for an improved battery mounting structure for a personal watercraft. In particular, there is a need for an improved battery mounting structure for a small watercraft, in which the battery mounting structure provides waterproofing protection for a battery stored therein, and improves the turning characteristics of the small watercraft.

SUMMARY OF THE INVENTION

The present invention provides a battery mounting structure for a small watercraft in which turning performance is improved, while a battery is stored in the inventive mounting structure is substantially waterproofed, so that the risk of water contacting the battery is minimized.

The battery mounting structure according to a first embodiment of the invention is provided for use with a small watercraft, including a vessel body having a hull constituting a lower portion of the vessel body, and a deck situated on top of the hull. It is intended that the watercraft include an engine disposed in the vessel body, a drive shaft extending rearwardly from the engine for driving a propeller, and a drive shaft supporting box for supporting the drive shaft at the midsection thereof. The battery mounting structure hereof is constructed and arranged to fit on top of the drive shaft supporting box so that when placed therein, the battery is disposed on the drive shaft supporting box.

Consequently, the battery is disposed at the central area of the vessel body, close to the longitudinal axis thereof, and as a result, the weight balance of the batteries is substantially centralized (to place heavy parts at the center of the vessel as much as possible). As a result of this centralized weight balance, turning performance of the vessel is improved.

Since the battery is disposed on the drive shaft supporting box, the battery is located at a significantly higher level above the bottom of the vessel, and thus contact with water in the hull is minimized.

Therefore, when the vessel body is rotated to the upright position after having rolled over, the battery is significantly protected from getting wet. Therefore, waterproofing of the battery may be simplified due to decreased chances of water contact.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

Figure 1:
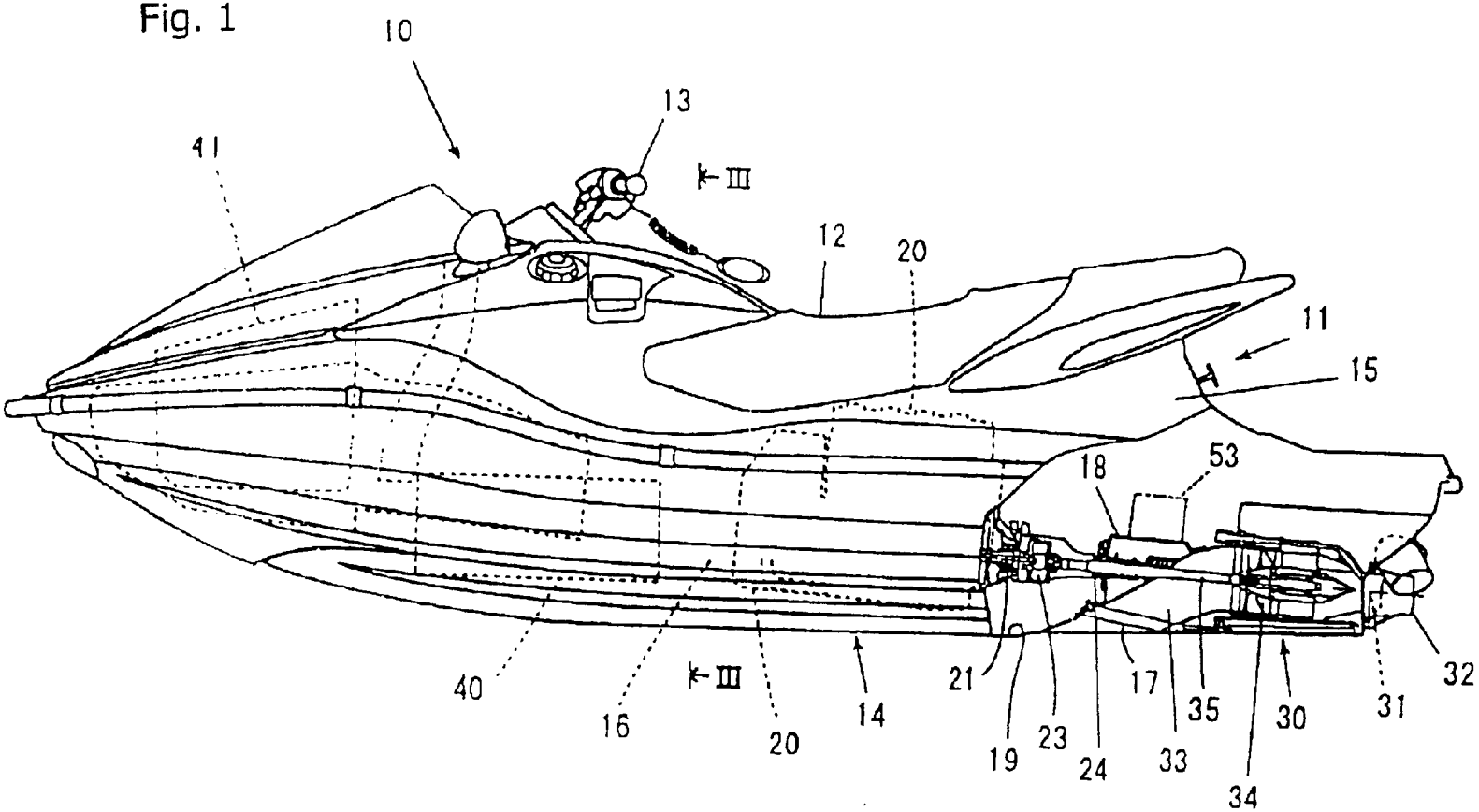
FIG. 1 is a side view, partially cut away, of a small water vessel employing a battery mounting structure according to a selected illustrative embodiment of the present invention.

As shown in the drawings (mainly in FIG. 1), the small watercraft 10 is a saddle riding type small watercraft in which an operator is able to sit on a seat 12 of a vessel body 11, and to operate while gripping a steering handle 13 with a throttle lever incorporated therein.

The vessel body 11 is a floating structure formed by joining a hull 14 and a deck 15 for defining a space 16 inside. In the space 16, a water-cooled engine 20 is mounted at substantially the center (substantially longitudinal and lateral center) on the hull 14, and a jet pump (jet propulsion pump) 30 as propulsion means driven by the water-cooled engine 20 is mounted at the rear of the hull 14.

A drive shaft (more specifically, a drive shaft for an impeller 34 described below) 35 of the jet pump 30 extends rearwardly from the engine 20, and is supported at the midsection thereof by a drive shaft supporting box 18 via a bearing unit 24.

The jet pump 30 includes a channel 33 extending from a water intake 17 opening toward the bottom through a jet flow port 31 opening toward the rear end of the vessel body to a deflector 32, and the impeller 34 disposed in the channel 33, and the drive shaft 35 of the impeller 34 is connected to an output shaft 21 of the engine 20 via a coupler 23.

Figure 2:
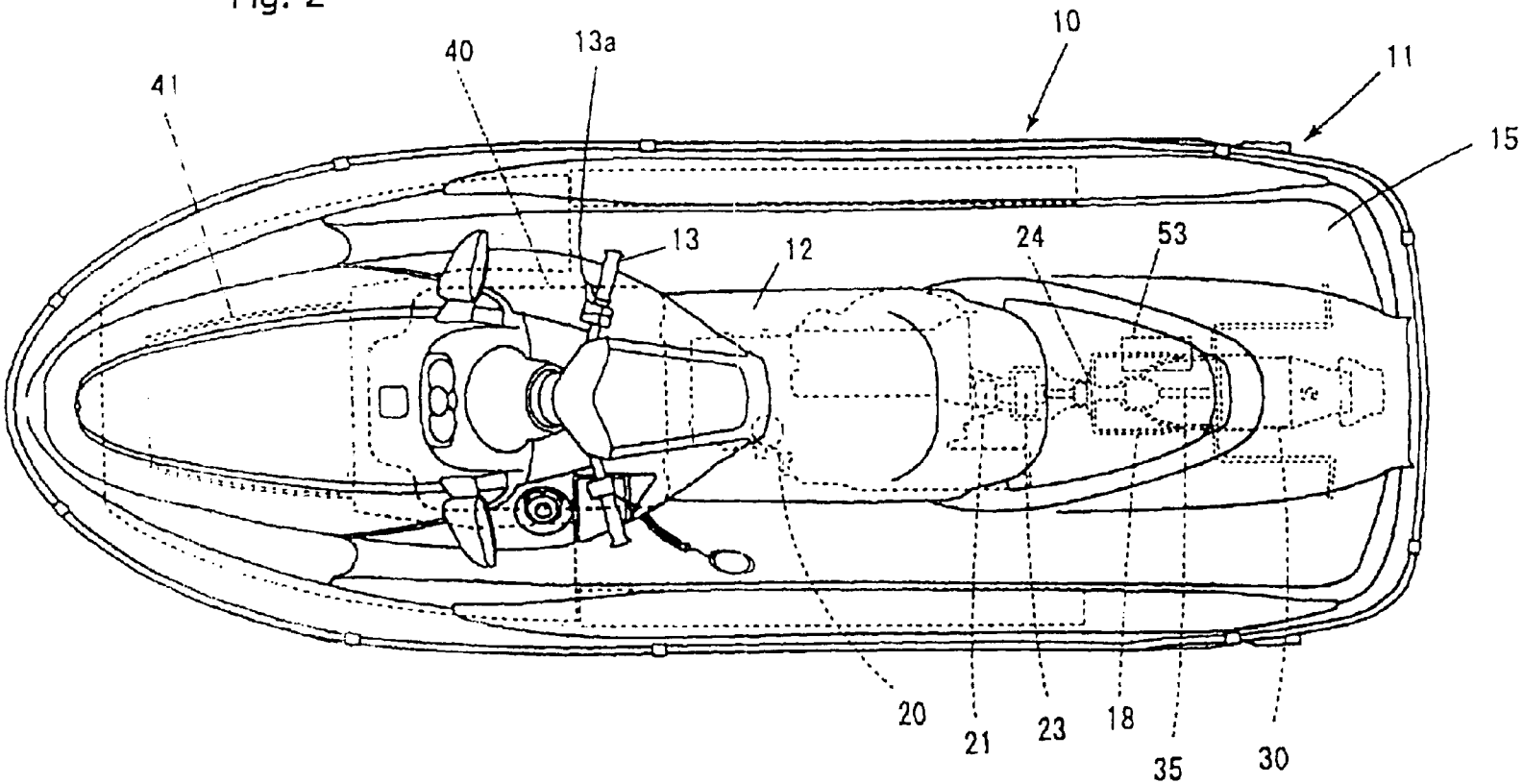
FIG. 2 is a plan view of the small water vessel of FIG. 1.

Therefore, when the impeller 34 is rotated by the engine 20, water taken from the water intake 17 is injected from the jet flow port 31 through the deflector 32, whereby the vessel body 11 is propelled. The throttle of the engine 20, that is, propelling power generated by the jet pump 30, is controlled by rotating the throttle lever 13*a* (See FIG. 2) of the operating handle 13. The deflector 32 is linked to the operating handle 13 via an operating wire, not shown, and operated by rotating the operating handle 13, whereby the direction of travel can be changed.

Reference numeral 40 designates a fuel tank, and numeral 41 designates a storage chamber.

The small watercraft 10 of this type is sometimes used for sport racing, and when it is so used, improvement of turning performance is desired. It will be appreciated that when using conventional lead-acid batteries or other commercially available electric storage batteries for watercraft, the batteries are relatively heavy, and the placement thereof influences the boat's performance. Therefore, in a battery mounting structure according to the present invention, the battery or batteries are stored as close to the center of the boat as possible, to improve the turning performance.

Another concern is that at times during operation of the small watercraft 10, the watercraft overturns in the water, and subsequently, after the vessel has been returned to its upright position, a small amount of water remains in the vessel body 11.

Therefore, in the battery mounting structure according to the depicted embodiment, a battery 53 is disposed on the drive shaft supporting box, to elevate it above residual water which may pool in the bottom of the hull 14.

Figure 4:
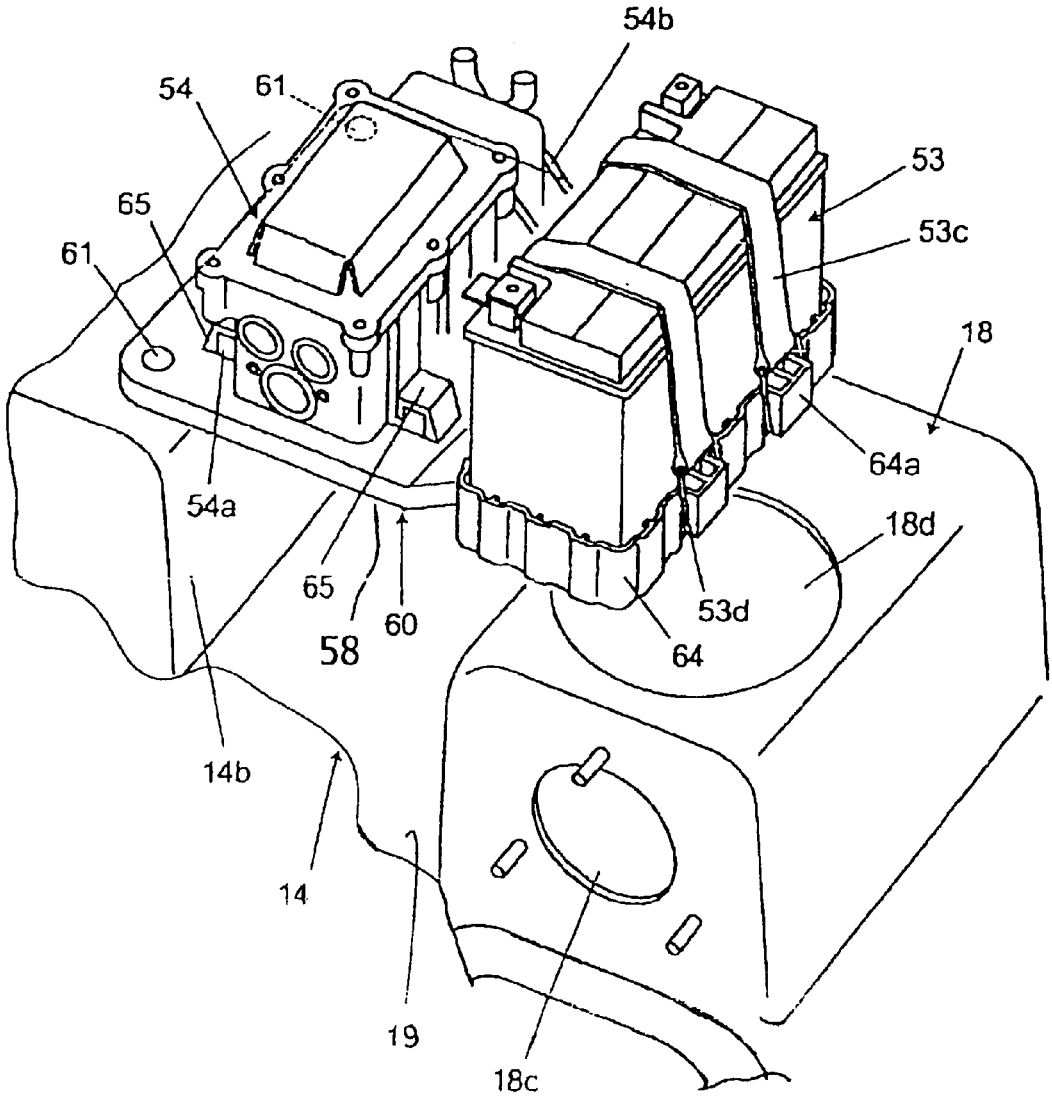
FIG. 4 is a perspective view showing a battery mounting structure according to the selected embodiment hereof.
Figure 5:
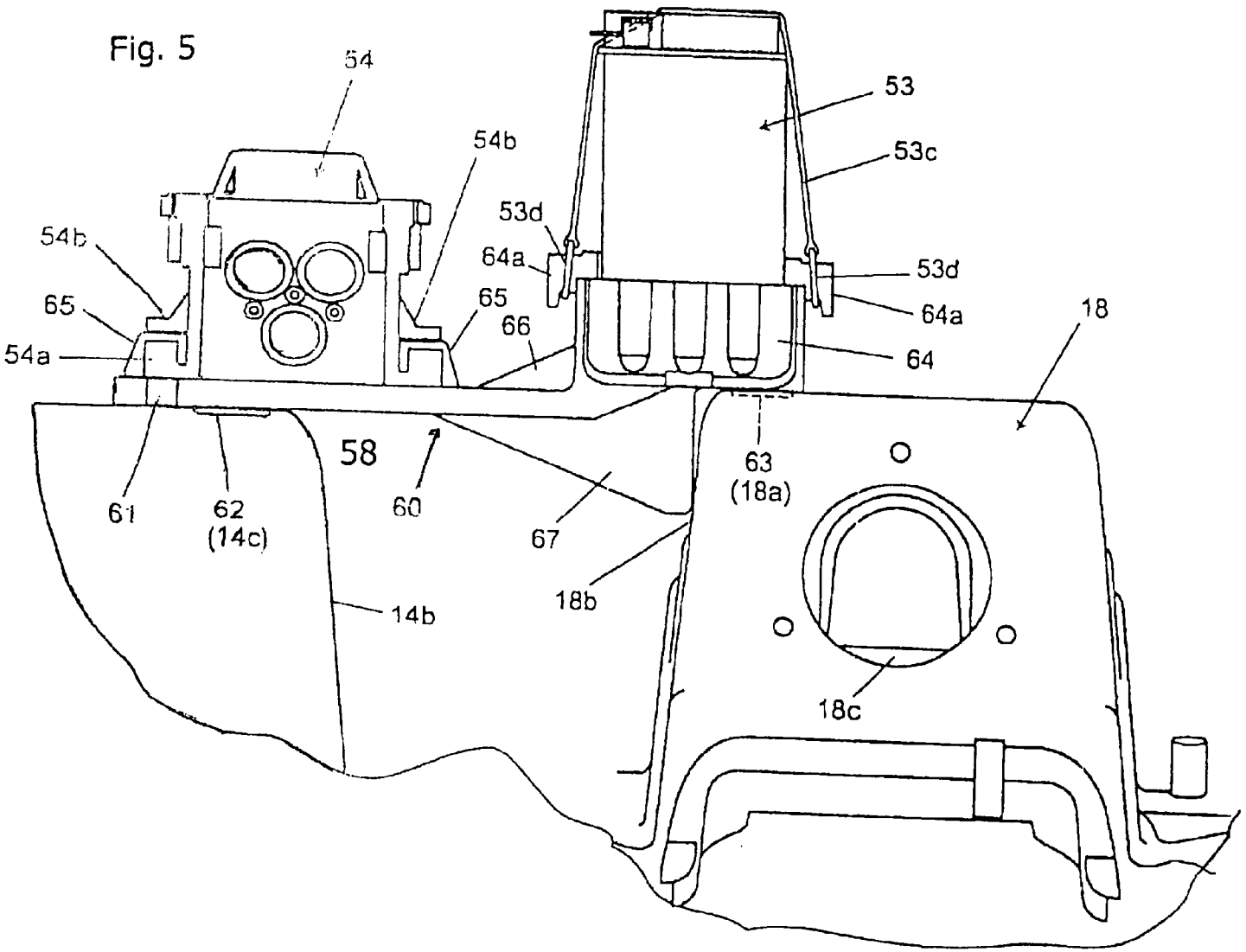
FIG. 5 is a front plan view of the battery mounting structure of FIG. 4.
Figure 6B:
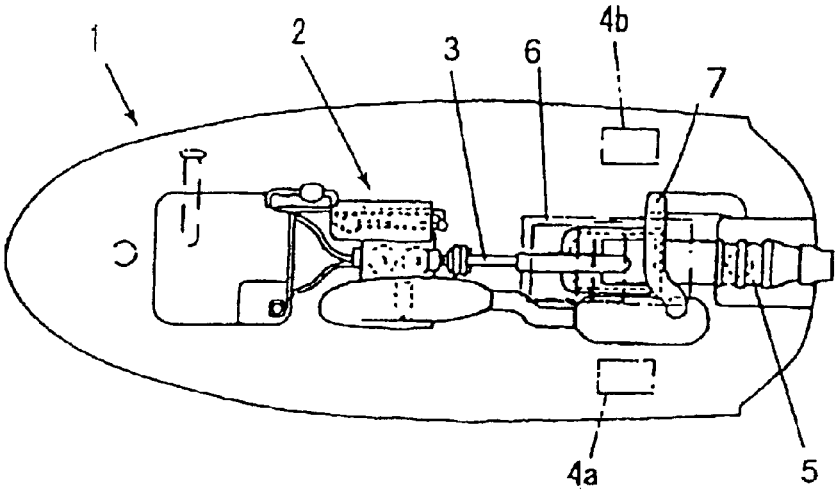
Fig. 6b PRIOR ART
FIGS. 6(*a*) and 6(*b*) are explanatory drawings of a small watercraft from the prior art, reproduced from the drawings of Japanese reference JP-A-10-194195.
Figure 6A:
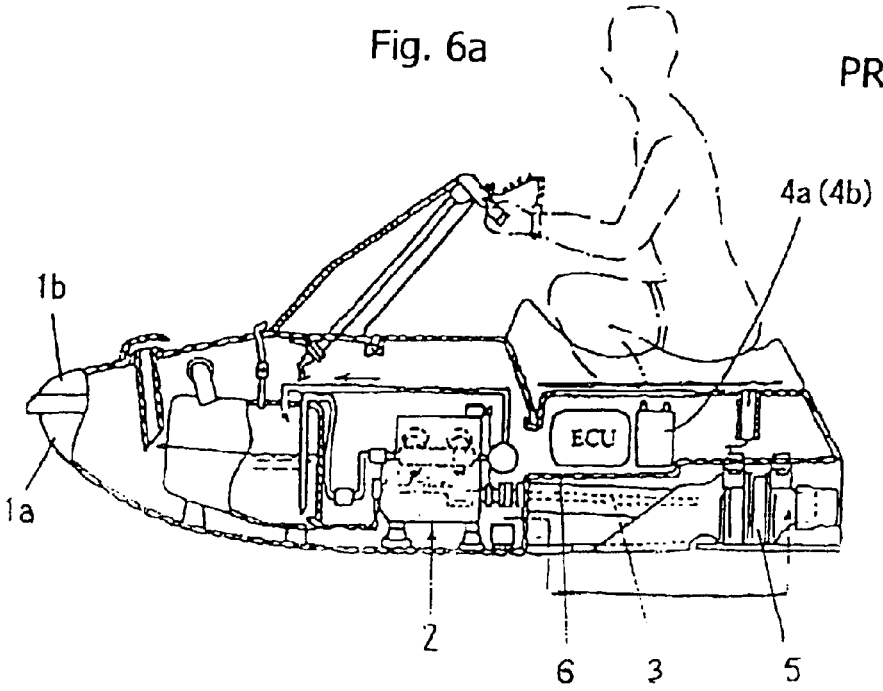
Fig. 6a PRIOR ART

FIG. 4 is a perspective view showing a battery mounting structure according to an illustrative embodiment of the present invention, and FIG. 5 is a front view of the battery structure of FIG. 4.

In these drawings, reference numeral 60 designates a battery mounting structure, including a battery tray 64 joined to and integrally formed with a platform section 58. The battery mounting structure 60 has bolt holes 61, 61 formed therethrough, and has a pair of spaced apart projections 62, 63 extending downwardly on the bottom thereof, as shown. The upper and lower surfaces of the battery mounting structure 60 are formed with reinforcing ribs 66, 67 extending between the battery tray 64 and the platform section 58.

The battery mounting structure 60 is attached to the aforementioned rib 14*b* of the hull 14 and to the drive shaft supporting box 18, so as to straddle therebetween. This is accomplished by fitting the projections 62, 63 on the bottom of the battery mounting structure 60 into the respective recesses 14*c* and 18*a*, formed on the upper surface of the hull rib 14*b* and on the upper surface of the drive shaft supporting box 18. The reinforcing rib 67 on the lower surface is abutted against a side surface 18*b* of the drive shaft supporting box 18 for positioning thereof, and then bolts, not shown, are extended through the bolt holes 61, 61, and fixed in place by nuts (not shown).

In the mounted state, the battery tray 64 is disposed on top of the drive shaft supporting box 18. This elevates the battery above the floor of the vessel body 11, and helps to keep it away from any water that may accumulate in the bottom of the hull 14.

The battery 53 is indirectly emplaced on the drive shaft supporting box 18, by being mounted on the battery tray 64 which rests on the drive shaft supporting box 18. A rubber strap 53*c* is provided for fixing the battery 53 to the battery tray 64, by detachably placing connecting rings 53*d* on opposite ends of the strap over hooks 64*a* provided on the battery tray 64.

The platform section 58 of the battery mounting structure 60 serves as a support member for a magnet box 54, and the platform structure includes mounting clamps 65 for the magnet box 54. Although only two of the mounting clamps 65 are shown in the drawings, they are formed at four points on the platform section 58.

The magnet box 54 is mounted to the mounting member 60 by slidably fitting hooks 54*a* on the magnet box under the mounting clamps 65, and fixing mounting arms 54*b*, 54*b* to the platform section 58 of the mounting member 60, using bolts and nuts (not shown).

Reference numeral 18*c* designates a mounting hole of the bearing unit 24, and numeral 18*d* designates a maintenance hole for the bearing unit 24.

The battery mounting structure hereof is provided for use on a small watercraft, which includes a vessel body 11 having a hull 14 constituting the lower portion thereof, and a deck 15 for covering the hull. The small watercraft also includes the engine 20 disposed in the vessel body 11, the drive shaft 35 extending rearwardly from the engine 20 for driving the propeller 30, and the drive shaft supporting box 18 for supporting the drive shaft 35 at the midsection thereof. In the practice of the present invention, and using the described battery mounting structure 60, the battery 53 is disposed on the drive shaft supporting box 18. Consequently, the battery 53 is disposed proximate the lateral center of the vessel body 11 (See FIG. 2).

Therefore, it becomes easy to strike a weight balance and to centralize a mass (to place heavy parts at the center of the vessel body 11 as much as possible) of the vessel body 11, and thus improvement of turning performance is achieved.

Since the battery 53 is disposed on the drive shaft supporting box 18, the battery 53 is located at a significantly higher level above the bottom floor 19 of the hull 14 (See FIG. 1, FIG. 4).

Figure 3:
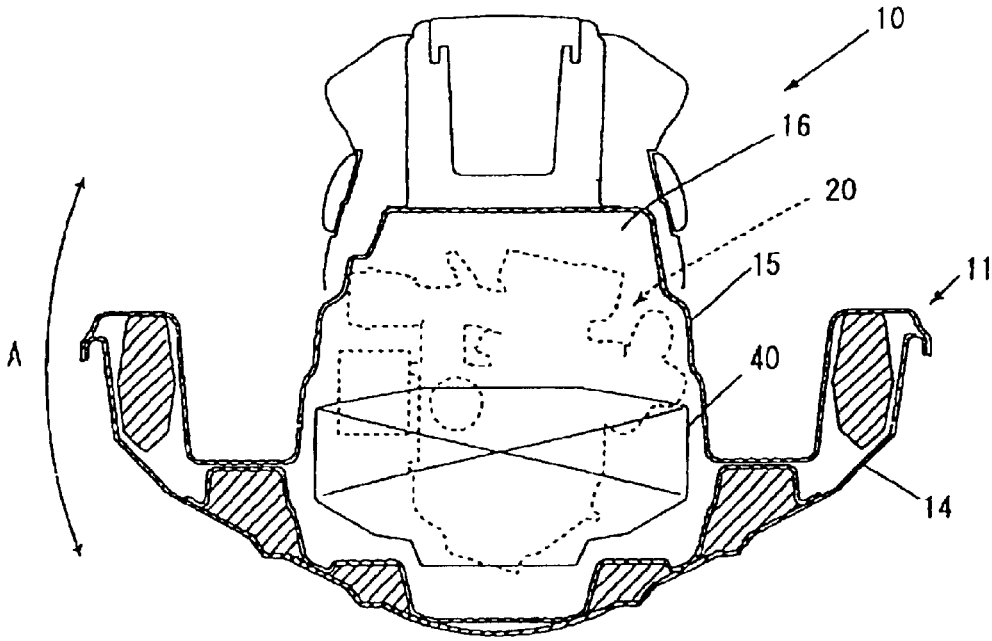
FIG. 3 is a partly enlarged cross-sectional view taken along the line III—III in FIG. 1, with some details omitted for purposes of simplicity in illustration.

Therefore, when the vessel body 11 is turned as shown by an arrow indicated by A in FIG. 3 for restoring the vessel body 11 to its normal posture after having rolled over, the battery 53 is protected from getting wet significantly. Therefore, waterproofing of the battery 53 may be simplified.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

What is claimed is:

1. A battery mounting structure for use in a small watercraft comprising a vessel body having a hull comprising a lower portion of the vessel body, and a deck for covering placement on top of the hull, an engine disposed in the vessel body, a drive shaft extending rearwardly from the engine for driving a propeller, and a drive shaft supporting box for supporting the drive shaft at the midsection thereof, said battery mounting structure comprising a battery support tray for supportively holding a battery thereon and a contacting member integrally formed with said battery support tray for contacting part of a drive shaft supporting box;

wherein at least part of said battery mounting structure is adapted for placement on top of the drive shaft supporting box;

and wherein the contacting member comprises a contoured alignment section for matingly engaging a corresponding surface of the drive shaft supporting box when the battery support tray is placed thereon.

2. The battery mounting structure of claim 1, further comprising at least one securing strap for use in securing said battery to said battery support tray.

3. A battery mounting structure of claim 1, further comprising structure for accommodating any one of a number of different-sized batteries.

4. A battery mounting structure of claim 1, wherein said battery tray comprises a plurality of hooks to receive securing straps thereon to secure a battery to said battery mounting structure.

5. The battery mounting structure of claim 1, further comprising a platform section integrally formed with said battery tray, said platform section configured to support a magnet box thereon.

6. The battery mounting structure of claim 5, further comprising at least one reinforcing rib extending between said battery tray and said platform section.

7. A method of mounting a battery in a personal watercraft having a longitudinal axis, said method comprising the steps of:

a) installing a battery mounting apparatus in said personal watercraft behind an engine and above a drive shaft support box of said watercraft, wherein the battery mounting apparatus comprises a support tray having a contoured alignment section comprising a projection which matingly engages a corresponding recess of the drive shaft supporting box;

b) placing a battery on the support tray of said battery mounting apparatus, and c) placing battery restraints on said battery to hold it in place on said support tray, whereby said battery is emplaced proximate the longitudinal axis of said watercraft.

8. A method of mounting a battery in a personal watercraft having a longitudinal axis, said method comprising the steps of:

a) installing a battery mounting apparatus in said personal watercraft behind an engine and above a drive shaft support box of said watercraft, wherein the battery mounting apparatus comprises a support tray having a contoured alignment section which matingly engages a corresponding surface of the drive shaft supporting box, the battery support tray being placed in the watercraft such that a first part of said battery mounting structure rests on top of the drive shaft supporting box, and a second part of said battery mounting structure rests on top of an interior surface of a hull of the watercraft, b) placing a battery on the support tray of said battery mounting apparatus, and c) placing battery restraints on said battery to hold it in place on said support tray, whereby said battery is emplaced proximate the longitudinal axis of said watercraft.

9. A small watercraft, comprising:

a vessel body having a hull comprising a lower portion of the vessel body, and a deck for covering placement on top of the hull;

an engine disposed in the vessel body;

a drive shaft extending rearwardly from the engine for driving a propeller, and a drive shaft supporting box for supporting a medial portion of the drive shaft, the drive shaft supporting box comprising side walls which are laterally spaced from the hull of the watercraft, the drive shaft supporting box further comprising an upper surface; and a battery mounting structure comprising:

a battery support tray for supportively holding a battery thereon, and a contacting member integrally formed with said battery support tray for contacting the drive shaft supporting box, wherein the contacting member comprises a contoured alignment section which matingly engages a corresponding surface of the drive shaft supporting box;

wherein a first part of said battery mounting structure rests on top of the drive shaft supporting box, and a second part of said battery mounting structure rests on top of an interior surface of the hull.

10. A small watercraft, comprising:

a vessel body having a hull comprising a lower portion of the vessel body, and a deck for covering placement on top of the hull;

an engine disposed in the vessel body;

a drive shaft extending rearwardly from the engine for driving a propeller, and a drive shaft supporting box for supporting a medial portion of the drive shaft, the drive shaft supporting box comprising side walls which are laterally spaced from the hull of the watercraft, the drive shaft supporting box further comprising an upper surface having a recess formed therein; and a battery mounting structure comprising:

a battery support tray for supportively holding a battery thereon, and a contacting member integrally formed with said battery support tray for contacting the drive shaft supporting box, wherein the contacting member comprises a contoured alignment section which matingly engages a corresponding surface of the drive shaft supporting box;

wherein the contoured alignment section of the contacting member comprises a projection extending downward from an underside surface of the battery support tray, the projection fitting into the recess in the upper surface of the drive shaft supporting box, so as to help maintain the position of battery mounting structure on the drive shaft supporting box.

11. The small watercraft of claim 10, wherein a first part of said battery mounting structure rests on top of the drive shaft supporting box, and a second part of said battery mounting structure rests on top of an interior surface of the hull.

12. A battery mounting structure for use in a small watercraft comprising a vessel body having a hull comprising a lower portion of the vessel body, and a deck for covering placement on top of the hull, an engine disposed in the vessel body, a drive shaft extending rearwardly from the engine for driving a propeller, and a drive shaft supporting box for supporting the drive shaft at the midsection thereof, said battery mounting structure comprising a battery support tray for supportively holding a battery thereon and a contacting member integrally formed with said battery support tray for contacting part of a drive shaft supporting box;

wherein at least part of said battery mounting structure is adapted for placement on top of the drive shaft supporting box;

wherein the contacting member comprises a contoured alignment section for matingly engaging a corresponding surface of the drive shaft supporting box when the battery support tray is placed thereon, said contoured alignment section comprising a projection extending downwardly from a lower surface of said battery support tray, for matingly engaging a recess of the drive shaft supporting box.

13. The battery mounting structure of claim 12, further comprising a platform section integrally formed with said battery tray and configured to support a magnet box thereon.

14. The battery mounting structure of claim 1, wherein said contacting member comprises a rib extending downwardly from a lower surface of said battery support tray, and wherein said rib comprises a side surface adapted for abuttingly contacting a side surface of said drive shaft supporting box when said battery mounting structure is installed in said watercraft.

15. The battery mounting structure of claim 14, wherein said rib extends downwardly below an outboard portion of said battery support tray, and is absent below an inboard portion of said battery support tray.

* * * * *